United States Patent [19]

Pearcy

[11] 4,234,989

[45] Nov. 25, 1980

[54] ADJUSTABLE PEDESTAL FOR A BOAT SEAT

[76] Inventor: Frank Pearcy, 4212 Beethoven, St. Louis, Mo. 63116

[21] Appl. No.: 876,575

[22] Filed: Feb. 10, 1978

[51] Int. Cl.[3] ..... B63B 29/00; A47C 1/031

[52] U.S. Cl. ..... 9/7; 92/53; 248/404; 248/157; 297/347

[58] Field of Search ..... 248/404, 157, 399, 460, 248/161, 188.5, 159, 162; 297/345, 347; 92/51, 52, 77, 161, 53; 9/7

[56] References Cited

U.S. PATENT DOCUMENTS

| | | | |
|---|---|---|---|
| 625,425 | 5/1899 | Sonnex | 92/53 |
| 1,095,926 | 5/1914 | Powell | 92/53 |
| 2,081,248 | 5/1937 | Murphy | 248/161 |
| 3,249,330 | 5/1966 | Preis | 248/400 |
| 3,436,048 | 4/1969 | Greer | 297/347 |
| 3,642,320 | 2/1972 | Ward | 9/7 X |
| 3,736,897 | 6/1973 | Krutz | 9/7 |
| 3,880,465 | 4/1975 | Scheben | 297/345 |
| 3,912,248 | 10/1975 | Pickford et al. | 248/400 |
| 4,008,500 | 2/1977 | Hall | 9/7 |
| 4,075,929 | 2/1978 | Peterson | 92/51 |
| 4,143,436 | 3/1979 | Jones | 9/7 |

FOREIGN PATENT DOCUMENTS

| | | | |
|---|---|---|---|
| 209497 | 11/1956 | Australia | 92/53 |
| 84544 | 3/1958 | Denmark | 92/53 |
| 610826 | 10/1960 | Italy | 92/53 |
| 122141 | 9/1927 | Switzerland | 92/53 |

*Primary Examiner*—Lawrence J. Staab
*Attorney, Agent, or Firm*—Senniger, Powers, Leavitt and Roedel

[57] ABSTRACT

A pneumatically adjustable pedestal for a boat seat comprising an assembly of telescoping sections, the assembly comprising a cup-shaped base section adapted to be inset in an opening in a deck of a boat and having a flange bearing on the floor around the opening, and intermediate sections and an upper end section adapted pneumatically to be raised and lowered, the upper end section being adapted for mounting a boat seat at its upper end, each successive section from the top down being retractable into the next section below, whereby the seat may be lowered to a level adjacent the deck, the sections being pneumatically upwardly extensible.

1 Claim, 3 Drawing Figures

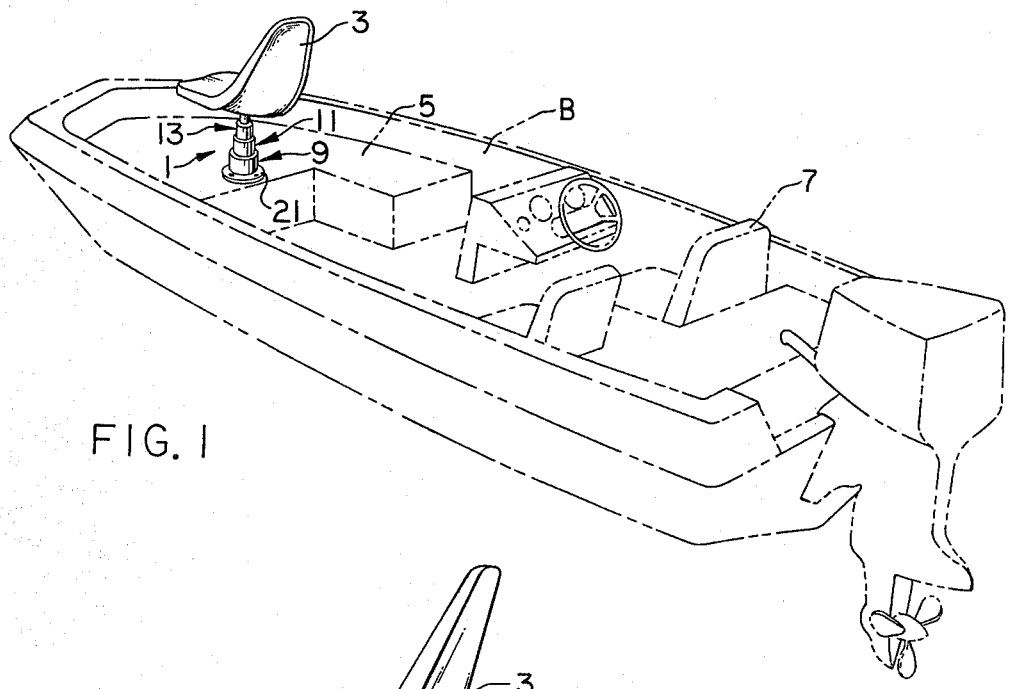
FIG. 1
FIG. 2
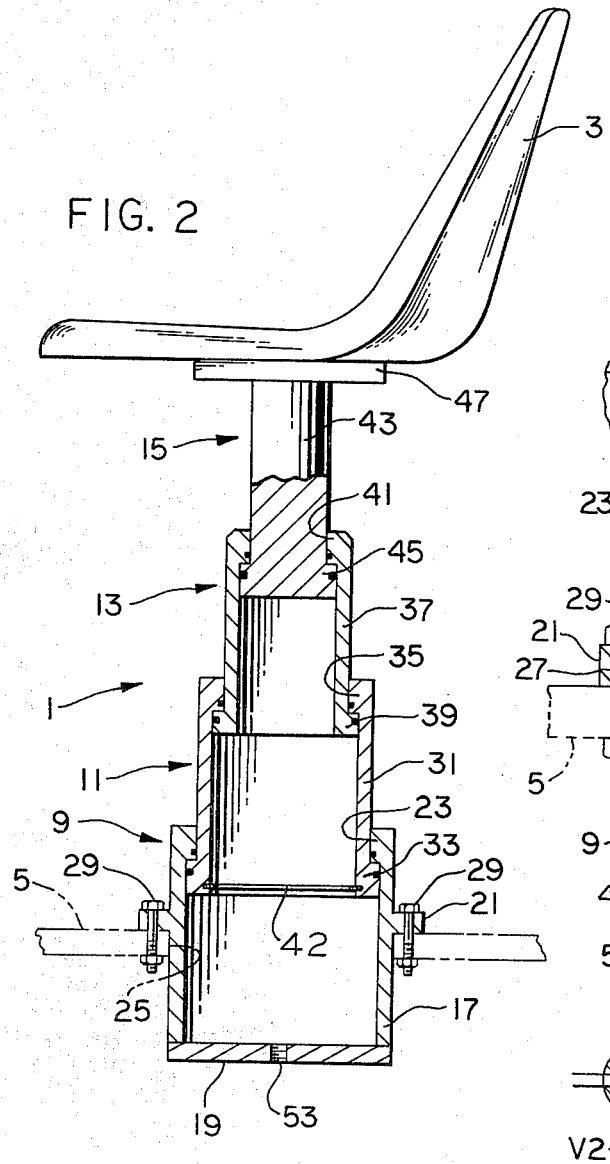
FIG. 3
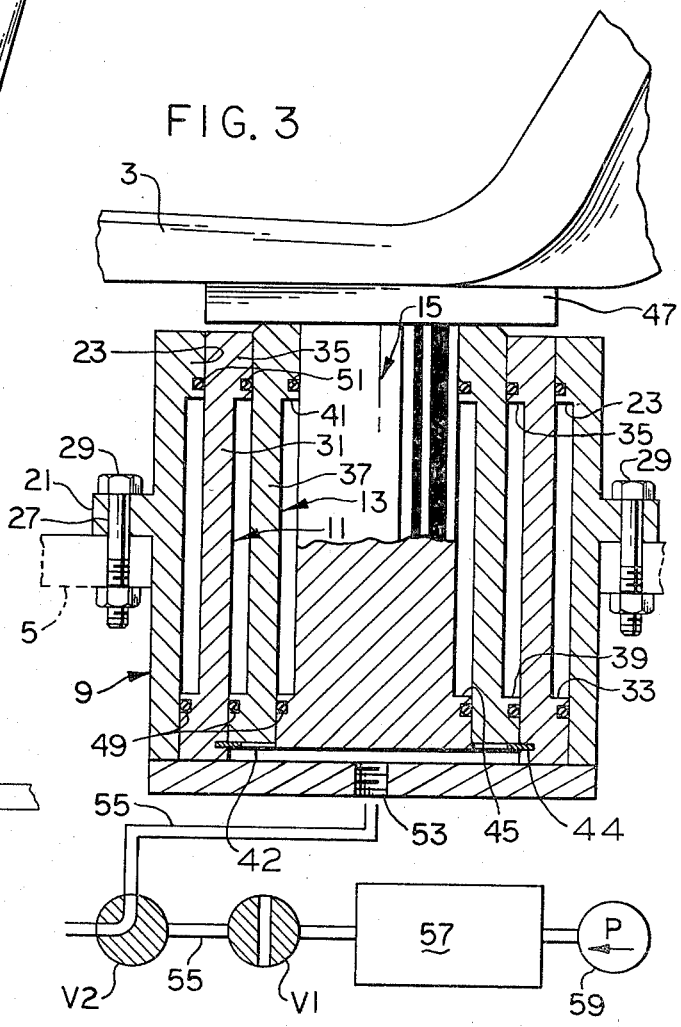

ADJUSTABLE PEDESTAL FOR A BOAT SEAT

BACKGROUND OF THE INVENTION

This invention relates to an adjustable pedestal for a boat seat, and more particularly to a pneumatically adjustable pedestal for mounting on a deck of a fishing boat for carrying a fisherman's seat, with the seat adjustable to different levels relative to the deck.

The invention is especially concerned with adjustable pedestals for use in fishing boats, and particularly such boats as are used by bass fishermen, for mounting a boat seat in the boat with the height of the boat seat above the deck adjustable.

SUMMARY OF THE INVENTION

Among the several objects of the invention may be noted the provision of an adjustable pedestal for a boat seat, the pedestal being adapted readily to be mounted on a deck of a fishing boat, and being readily adjustable to raise and lower a seat carried by the pedestal at its upper end; the provision of such a pedestal which, as mounted on a deck of a boat, enables the seat readily to be lowered to a fully lowered position as close as generally possible to the deck for running the boat about with minimum obstruction to vision of the boat pilot, and to be readily raised for use by a fisherman to a height convenient for his use; and the provision of such a pedestal which is pneumatically operable, using an electric-motor-driven air pump which may be powered from the battery for the boat motor.

In general, a pneumatically adjustable pedestal of this invention for a boat seat comprises an assembly of telescoping sections, this assembly comprising a base section, intermediate sections and an upper end section. The base section comprises a cup-shaped body having a cylindrical wall and a bottom, with an annular external mounting flange extending radially outwardly from the cylindrical wall at a level above the bottom of the base section and an annular internal flange extending radially inwardly from the cylindrical wall at the upper end of the base section. The base section is adapted to be mounted in an opening in a deck of a boat with the stated external flange bearing on the deck around the opening, this flange being adapted to receive fasteners for securing the base section to the deck. Each intermediate section comprises a tubular cylindrical section having an annular flange extending radially outwardly at its lower end and an annular flange extending radially inwardly at its upper end. The upper end section comprises a cylindrical section having an annular flange extending radially outwardly at its lower end and is adapted for mounting a boat seat at its upper end. Each successive section from the base section up is of such diameter as to have a sliding fit in the upper end flange of the next section below. All of the sections are generally of the same height. Each successive section from the top down is retractable into the next section below whereby the sections other than the base section are retractable one into another and into the base section for lowering a seat mounted on the upper end of the upper end section to a level closely adjacent the upper end of the base section. The base section has a port for admission of air under pressure to extend the intermediate and upper end section for raising the seat and for exhaust of air for enabling the sections above the base section to telescope one into another and into the base section for lowering the seat, with the sections above the base section extensible to an upper limit determined by engagement of the said lower end flanges with the said upper end flanges.

Other objects and features will be in part apparent and in part pointed out hereinafter.

BRIEF DESCRIPTION OF THE DRAWINGS

FIG. 1 is a perspective showing a typical fishing boat equipped with a pedestal of this invention, showing the pedestal extended to raise the seat thereon;

FIG. 2 is a vertical section of the pedestal showing it in its fully extended (raised) condition for the raising of the seat to the upper limit; and FIG. 3 is a vertical section of the pedestal showing it in its fully retracted (lowered) condition for the lowering of the seat.

Corresponding reference characters indicate corresponding parts throughout the several views of the drawings.

DESCRIPTION OF THE PREFERRED EMBODIMENT

Referring to the drawings, a pneumatically adjustable pedestal of this invention for a boat seat is generally indicated by the reference numeral 1, the seat carried by the pedestal being indicated by the reference numeral 3. FIG. 1 shows the pedestal mounted in a typical bass fishing boat B on a deck 5 at the bow of the boat. The pedestal is shown as extended and the seat raised, and it will be apparent how the seat in the raised position may obscure the forward view of the pilot of the boat (who is seated at 7). The seat is shown as a typical fiberglass seat; it could be a fold-down upholstered seat. The pedestal is adapted to be retracted (lowered) to bring the seat down to a position closely adjacent the deck for less interference by the seat to the pilot's forward vision.

The pedestal 1 comprises an assembly of telescoping sections, the assembly comprising a base section 9, first and second intermediate sections 11 and 13, and an upper end or top section 15. The base section is adapted to be secured to the deck of the boat and the top section is adapted for mounting the boat seat 3 at its upper end.

The base section 9 comprises a cup-shaped body having a cylindrical wall 17 and a flat circular bottom 19, with an annular external mounting flange 21 extending radially outwardly from the cylindrical wall 17 at a level above the bottom 19, and an annular external flange 23 extending radially inwardly from the cylindrical wall 17 at the upper end of the base section. As shown, the external mounting flange 21 is at a level intermediate the bottom and upper end of the base section, e.g., somewhat above the center of height of wall 17. It is adapted to be mounted in a circular opening 25 cut in the deck with flange 21 bearing on the deck around the opening. Flange 21 has holes 27 for receiving suitable fasteners 29, e.g., bolts, for securing the base section 9 to the deck.

The first intermediate section 11 is of tubular cylindrical form, comprising a tubular cylindrical body 31 having an external diameter such as to have a sliding fit in the upper end flange 23 of the base section 9. Section 11 is generally of the same height as the wall 17 of the base section 9. It has an annular external flange 33 extending radially outwardly at its lower end and an annular internal flange 35 extending radially inwardly at its upper end. The lower end flange 33 is made with its external diameter such as to have a sliding fit in the cylindrical wall 17 of the base section 9, the bottom of this flange being engageable with the bottom 19 of the base section 9 to limit the downward movement of section 11 in section 9 (see FIG. 3), and the top of this flange being engageable with the internal upper end flange 23 of section 9 to limit the upward movement of section 11 relative to section 9.

The second intermediate section 13, like section 11, is of tubular cylindrical form, comprising a tubular cylindrical body 37 having an external diameter such as to have a sliding fit in the upper end flange 35 of section 11. Section 13 is generally of the same height as section 11. It has an annular external flange 39 extending radially outwardly at its lower end and an annular internal flange 41 extending radially inwardly at its upper end. The lower end flange 39 is made with its external diameter such as to have a sliding fit in the tubular cylindrical body 37 of section 11. The bottom of flange 39 is engageable with a stop 42 on the inside of section 11 adjacent its lower end to limit the downward movement of section 13 in section 11 (see FIG. 3), and the top of flange 39 is engageable with the internal upper end flange 35 of section 11 to limit the upward movement of section 13 relative to section 11. The stop 42 is constituted by a snap ring snapped into an internal annular groove 44 in section 11 adjacent its lower end.

The upper end section 15 is of solid cylindrical form, comprising a solid cylindrical body 43 having an external diameter such as to have a sliding fit in the upper end flange 41 of section 13. Section 15 is generally of the same height as section 13 (and section 11). It has an annular external flange 45 extending radially outwardly at its lower end, this flange being made with an external diameter such as to have a sliding fit in the tubular cylindrical body 37. The top of flange 45 is engageable with flange 41 of section 13 to limit the upward movement of section 15 relative to section 13.

The seat 3 is mounted on a conventional commercially available spring swivel mounting 47 on the upper end of section 15. This mounting projects out from the upper end of section 15 and its bottom is engageable with the upper end of section 13 (which extends up slightly above the upper end of section 11) to limit the downward movement of section 15 in section 13 (see FIG. 3). Air seals, such as conventional O-rings, are provided as indicated at 49 between the lower flanges 33, 39 and 45 of sections 11, 13 and 15 and the surrounding cylindrical bodies 17, 31 and 37 of sections 9, 11 and 13, and are also provided as indicated at 51 between the upper flanges 23, 35 and 41 of sections 9, 11 and 13 and sections 11, 13 and 15.

The bottom 19 of the base section 9 has a port 53 for admission of air under pressure to the base section to act against the lower ends of section 15 and sections 11 and 13 to extend these sections as illustrated in FIG. 2 for raising the seat 3 and for exhaust of air for enabling the sections above the base section 9 to telescope one into another and into the base section 9 for lowering the seat. As shown in FIG. 3, air under pressure is adapted to be supplied to the port 35 via a line 55 from a compressed-air tank 57, this line 55 including two control valves V1 and V2. These valves, when set in a first position, supply air from the tank via line 55 to the port 53 to extend the pedestal 1 and raise the seat. Valve V1 is shown as an on-off valve adapted to be opened for communication from the tank 57 to port 53, and to be closed to cut off the port from the tank. Valve V2 is adapted to be set in a first position for flow of air to port 53 from valve V1 and in a second position for venting air from 53. The tank 57 is supplied with compressed air by means of an air pump 59 driven by an electric motor powered from the battery for the boat engine.

As will appear from FIG. 3, each successive section 15, 13, 11 from the top down is retractable into the next section below, i.e., 15 is retractable into 13 and 13 into 11, whereby the sections 15, 13, 11 (the sections other than the base section 9) are retractable one into another and into the base section 9 for completely lowering the seat 3 mounted on the upper end of the upper end section 15 to a level closely adjacent the upper end of the base section 9. This complete lowering is effected by completely exhausting air from within the pedestal via valve V1 being in its closed position (as shown in FIG. 3) and setting valve V2 in its stated second position (as shown in FIG. 3) for venting air from port 53. As shown in FIG. 3, the flange 45 at the lower end of section 15 lies within the stop ring 42 and the lower end of section 15 lies below the lower end of section 13 when section 15 is retracted. To extend the pedestal and raise the seat, valve V2 is set in its stated first position for flow of pressure air from valve V1 to valve V2 and valve V1 is opened for flow of air from the tank 57. The pedestal may be completely extended for raising the seat to its highest possible level by delivery of air for complete extension of sections 11, 13 and 15, i.e., raising of section 11 to the point where its lower end flange 33 engages the upper end flange 23 of section 9, raising of section 13 in 11 to the point where the lower end flange 39 of 13 engages the upper end flange 35 of 11, and raising of section 15 in 13 to the point where the lower end flange 45 of 15 engages the upper end flange 41 of 13, as appears in FIG. 2. Intermediate adjusted positions of the seat are readily obtained by partial admission to or exhaust of air from the pedestal, as will be apparent.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a boat having a deck, a pneumatically adjustable pedestal mounted on the deck, and a boat seat mounted on the pedestal, said pedestal comprising an assembly of telescoping sections; said assembly comprising a base section, first and second intermediate sections and an upper end section; said base section comprising a cup-shaped body having a cylindrical wall and a bottom, with an annular external mounting flange extending radially outwardly from said cylindrical wall at a level above the bottom of the base section and an annular internal flange extending radially inwardly from said cylindrical wall at the upper end of the base section; said base section being mounted in an opening in the deck of the boat with said external flange bearing on the deck around the opening, said flange being adapted to receive fasteners for securing the base section to the deck; each intermediate section comprising a tubular cylindrical section having an annular flange extending radially outwardly at its lower end and an annular flange extending radially inwardly at its upper end; the upper end section comprising a cylindrical section having an annular flange extending radially outwardly at its lower end, means at the upper end of said upper end section for mounting the boat set thereon; each successive section from the base section up being of such diameter as to have a sliding fit in the upper end flange of the next section below; all of said sections being generally of the same height; each successive section from the top down being retractable into the next section below whereby the sections other than the base section are retractable one into another and into the base section for lowering the seat mounted on the upper end of the upper end section to a level closely adjacent the upper end of the base section; the first intermediate section being retractable into the base section to the point where its lower end engages the bottom of the base section, the first intermediate section having inwardly extending stop means adjacent its lower end and the second intermediate section being retractable into the first intermediate section to the point where the lower end of the second intermediate section engages said stop means, and the upper end section being retractable into the second intermediate section, said seat mounting means extending laterally outwardly beyond the upper end section for engagement thereof with the upper end of the second intermediate section when it is retracted into the second intermediate section, the upper end section being retractable into the second intermediate section to the point where said seat mounting means engages the upper end of the second intermediate section, the flange at the lower end of the upper end section lying within said stop means and the lower end of the upper end section lying below the lower end of the second intermediate section when the upper end section is retracted; said base section having a port for admission of air under pressure to extend the intermediate and upper end sections for raising the seat and for exhaust of air for enabling the sections above the base section to telescope one into another and into the base section for lowering the seat, with the sections above the base section extensible to an upper limit determined by engagement of the said lower end flanges with the said upper end flanges; and means for supplying air under pressure to the pedestal through said port to extend the intermediate and upper end sections for raising the seat and for the exhaust of air from the pedestal for lowering the seat; said external mounting flange on said base section being located relative to the height of the base section for mounting the base section with its upper end substantially below normal seating levels and relatively closely adjacent the deck whereby, by fully retracting the intermediate and upper sections into the base section, the seat may be lowered to a fully retracted position closely adjacent the deck.

* * * * *